United States Patent [19]

Pirwitz

[11] 4,442,789

[45] Apr. 17, 1984

[54] PARTICLE MOVING AND DISPENSING SYSTEM

[75] Inventor: Robert G. Pirwitz, Webster, N.Y.

[73] Assignee: Xerox Corporation, Stamford, Conn.

[21] Appl. No.: 418,856

[22] Filed: Sep. 16, 1982

[51] Int. Cl.[3] ..... G03G 15/08

[52] U.S. Cl. ..... 118/653; 118/658

[58] Field of Search ..... 118/657, 658, 653

[56] References Cited

U.S. PATENT DOCUMENTS 3,363,806 1/1968 Blakeslee et al. ..... 222/70

FOREIGN PATENT DOCUMENTS 51550 10/1980 European Pat. Off. .

*Primary Examiner*—Bernard D. Pianalto

*Attorney, Agent, or Firm*—H. Fleischer; J. E. Beck; R. Zibelli

[57] ABSTRACT

An apparatus in which particles are discharged into the chamber of a housing storing a supply of developer material therein. The apparatus includes an auger having a multiplicity of spirally wound flexible fibers. As the flexible fibers rotate, they move the particles from a supply thereof to at least one exit port for discharge therefrom into the developer material.

4 Claims, 5 Drawing Figures

PARTICLE MOVING AND DISPENSING SYSTEM

This invention relates generally to an electrophotographic printing machine, and more particularly concerns a development apparatus having an improved particle dispensing and moving system for use therein.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the information contained within the original document. After the electrostatic latent image is recorded on the photoconductive member, the latent image is developed by bringing a developer material into contact therewith. This forms a toner powder image on the photoconductive member which is subsequently transferred to a copy sheet. Finally, the powder image is heated to permanently affix it to the copy sheet in image configuration.

A suitable developer material generally comprises carrier granules having tomer particles adhering triboelectrically thereto. This two-component mixture is brought into contact with the electrostatic latent image recorded on the photoconductive surface. A portion of the toner particles are attracted from the carrier granules to the latent image. These toner particles adhere to the latent image so as to form a powder image on the photconductive surface.

Various methods have been devised for applying developer material to the latent image. For example, the developer material may be cascaded over the latent image with the toner particles being attracted from the carrier granules thereto. Other techniques utilize magnetic filed producing devices which form brush-like tufts extending outwardly therefrom in contact with the photoconductive surface. In any event, it is apparent that during the development process, toner particles are depleted from the developer material. Thus, additional toner particles must be furnished to the developer material so as to maintain copy density at a substantially optimum level. Typically, a supply of toner particles is stored in a hopper and periodically or continuously dispensed therefrom into the developer material. Various approaches have been devised for dispensing toner particles into the developer material. The following disclosures appear to be relevant:

U.S. Pat. No. 3,659,556
Patentee: Mutschler
Issued: May 2, 1972
U.S. Pat. No. 4,142,655
Patentee: Fantuzzo
Issued: Mar. 6, 1979
Japanese Laid-Open No. 50-29145
Applicant: Canon Incorporated
Application Date: July 11, 1973
IBM Technical Disclosure Bulletin
Volume 15, No. 4, Sept., 1972
Page 1262
By: Queener
European Pat. No. 51-550
Applicant: Transitube Project
Issued: May 12, 1982
Co-Pending U.S. Application Ser. No. 104,225
Applicant: Spehrley, Jr.
Filed: Dec. 17, 1979
Co-Pending U.S. Application Ser. No. 288,586
Applicant: Hoffman, Jr.
Filed: July 30, 1981.

The relevant portions of the foregoing disclosures may be briefly summarized as follows:

Mutschler describes a development system in which toner particles are dispensed into a developer mixture. An auger transports the developer mixture to a donor roll.

Fantuzzo discloses a pair of flexible augers for transporting toner particles from a remote container to a toner dispenser positioned adjacent the development system.

The Japanese publication describes a toner container having a rotary driven vaned member located in the opening thereof for dispensing particles into a supply passage. A screw conveyor moves the toner particles to the developing unit.

Queener discloses a flexible auger for transporting toner particles from a first station to a second station located within an office copying machine.

The European patent describes a conveyor for transporting granular materials. The conveyor includes a brush consisting of a flexible rod with bristles and strands of wire mounted around the rod to form a continuous helix. The central rod is composed of a number of strands of wire which are twisted together in a helix and pinch the bristles between the strands. The flexible tube has formed in it an internal helical rib of the same pitch as the helix of the bristles and wire, but in the opposite direction. The brush is rotated and transports the material through the sleeve like a screw conveyor.

Spehrley, Jr. discloses a toner particle dispenser having a hopper storing a supply of toner particles therein. An auger is coupled to the hopper for receiving the toner particles and uniformly dispensing them into the center of the housing having developer material therein.

Hoffman, Jr. describes an auger formed from a helical member adapted to rotate in a tubular member for transporting toner particles therealong. Fibers extend inwardly from the exterior wall of the tubular member to contact the moving toner particles so as to induce relative movement between the toner particles and the auger in a direction substantially normal to the direction of translation thereof.

In accordance with one aspect of the present invention, there is provided an apparatus for discharging particles into the chamber of the housing storing a supply of developer material therein. Means, defining an open ended chamber, store a supply of particles therein. An enclosure, defining an elongated chamber having an entrance port in communication with the open end of the chamber in the storing means, receives particles therefrom. The enclosure has at least one exit for dispensing particles therefrom into the chamber of the housing storing the developer material therein. Means are provided for moving the particles received in the elongated chamber of the enclosure from the entrance port to the exit port thereof. In this way, the particles are dispensed from the enclosure into the chamber of the housing storing the developer material therein. The moving means comprises a support mounted rotatably in the elongated chamber of the enclosure. A multiplicity of flexible fibers are mounted on the support in a spiral configuration and extend outwardly therefrom. The free end portions of the fibers are closely adjacent to the interior surface of the enclosure.

Pursuant to another aspect of the present invention, there is provided an apparatus for developing an electrostatic latent image recorded on a photoconductive member used in an electrophotographic printing machine. A housing, defining a chamber, stores a supply of developer material comprising at least carrier granules and toner particles therein. Means, defining an open ended chamber, store a supply of toner particles therein. An enclosure, defining an elongated chamber having an entrance port in communication with the open end of the chamber in the storing means, receives toner particles therefrom. The enclosure has at least one exit port for dispensing toner particles therefrom into the chamber of the housing storing the developer material therein. Means are provided for moving the toner particles received in the elongated chamber of the enclosure from the entrance port to the exit port thereof for dispensing the toner particles therefrom into the chamber of the housing storing the developer material therein. The moving means comprises a support mounted rotatably in the elongated chamber of the enclosure. A multiplicity of flexible fibers are mounted on the support in a spiral configuration. The fibers extend outwardly from the support with the free end portions thereof being closely adjacent to the interior surface of the enclosure.

Other aspects of the present invention will become apparent as the following description proceeds and upon reference to the drawings, in which:

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
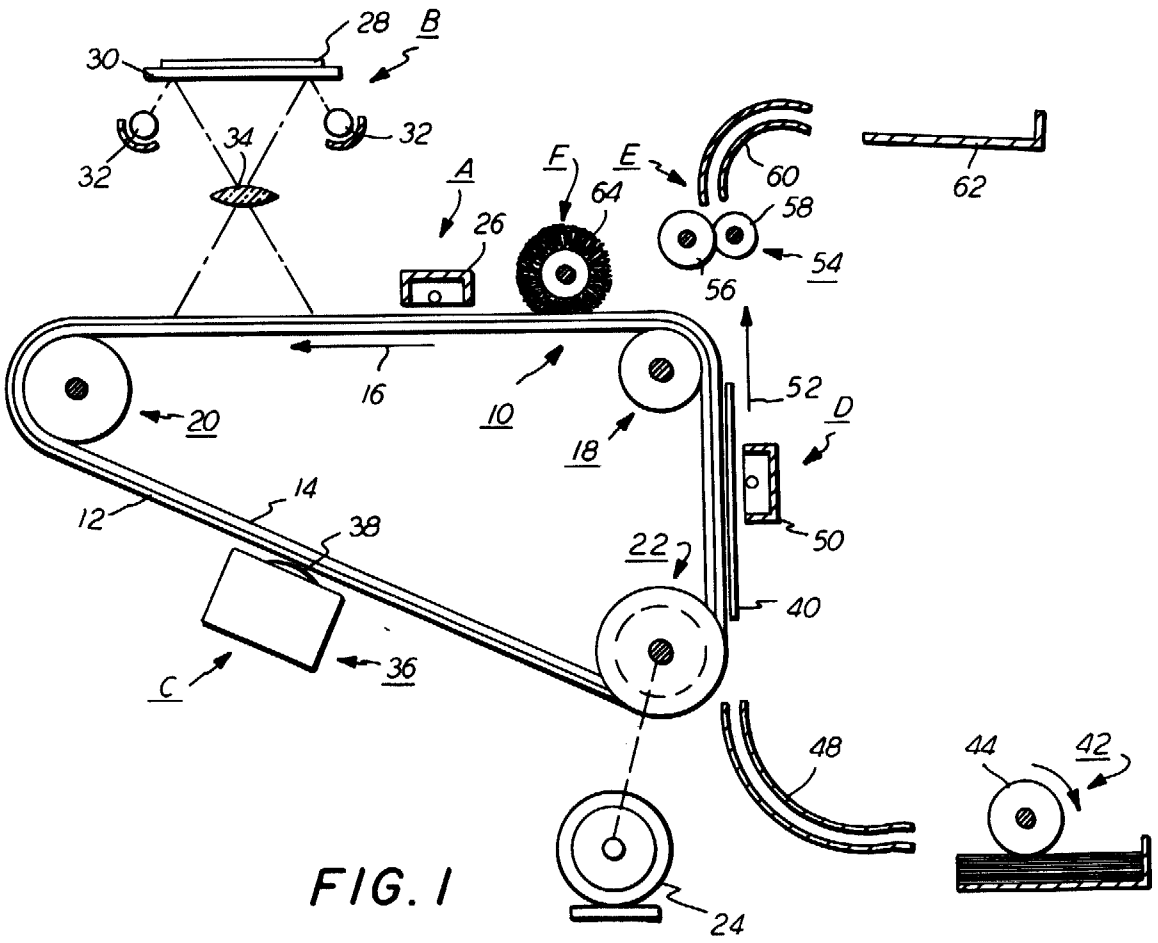
FIG. 1 is a schematic elevational view depicting an illustrative electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various elements of an illustrative electrophotographic printing machine incorporating the particle dispensing apparatus of the present invention therein. It will become evident from the following discussion that this apparatus is equally well suited for use in a wide variety of electrostatographic printing machines or other types of devices requiring the movement and dispensing of granular particles, and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

DETAILED DESCRIPTION OF THE DRAWINGS

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed in lieu thereof. Belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face down upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28. Thereafter, belt 10 advances the electrostatic latent image recorded on photoconductive surface 12 to development station C.

At development station C, a magnetic brush development system, indicated generally by the reference numeral 36, transports a developer mixture of carrier granules and toner particles into contact with the electrostatic latent image recorded on photoconductive surface 12. Magnetic brush development system 36 includes a magnetic brush developer roller 38. Magnetic brush developer roller 38 forms a brush of carrier granules and toner particles. The toner particles are attracted from the carrier granules to the electrostatic latent image forming a toner powder image on photoconductive surface 12 of belt 10. The detailed structure of magnetic brush development system 36 will be described hereinafter with reference to FIG. 2.

After development, belt 10 advances the toner powder image to transfer station D. At transfer station D, a sheet of support material is moved into contact with the toner powder image. The sheet of support material is advanced to transfer station D by a sheet feeding apparatus, indicated generally by the reference numeral 42. Preferably, sheet feeding apparatus 42 includes a feed roller 44 contacting the uppermost sheet of a stack of sheets 46. Feed roller 44 rotates to advance the uppermost sheet from stack 46 into chute 48. Chute 48 directs the advancing sheet of support material into contact with photoconductive surface 12 of belt 10 in a timed sequence so that the toner powder image developed thereon contacts the advancing sheet of support material 40 at transfer station D.

Transfer station D includes corona generating device 50 which sprays ions onto the backside of sheet 40. This attracts the toner powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to sheet 40. Preferably, fuser assembly 54 includes a heated fuser roll 56 and a back-up roll 58. Sheet 40 passes between fuser roll 56 and back-up roll 58 with the toner powder image contacting fuser roll 56. In this manner, the toner powder image is permanently affixed to sheet 40. After fusing, chute 60 guides the advancing sheet to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 64 in contact with photoconductive surface 12. The pre-clean corona generating device neutralizes the charge attracting the particles to the photoconductive surface. These particles are cleaned from photoconductive surface 12 by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an illustrative electrophotographic printing machine incorporating the features of the present invention therein.

Figure 2:
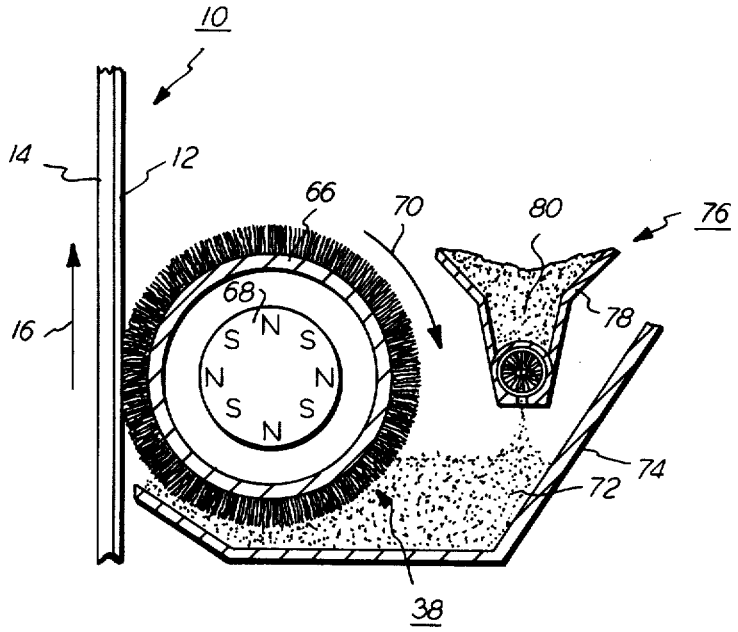
FIG. 2 is a schematic elevational view showing a development system used in the FIG. 1 printing machine.

Referring now to FIG. 2, there is shown development system 36 in greater detail. As depicted thereat, development system 36 includes a developer roller 38 having a non-magnetic tubular member 66. An elongated magnetic member 68 is positioned interiorly of tubular member 66 and spaced from the interior peripheral surface thereof. Tubular member 66 rotates in the direction of arrow 70 to advance the developer material into contact with the electrostatic latent image recorded on photoconductive surface 12 of belt 10. As tubular member 66 rotates in the direction of arrow 70, it passes through the sump of chamber 72 and housing 74. Developer material, disposed in chamber 72, is attracted to tubular member 66 by the magnetic field generated by elongated magnetic member 68. In this manner, the developer material is advanced into contact with the electrostatic latent image recorded on photoconductive surface 12 of belt 10. The electrostatic latent image attracts the toner particles from the developer material. Thus, toner particles are being continually depleted from the developer material. If additional toner particles were not furnished to the developer material, eventually, the copies would become progressively lighter and degrade in quality. To this end, a toner particle dispenser, indicated generally by the reference numeral 76, furnishes additional toner particles to chamber 72 of housing 74. Toner particle dispenser 76 includes a hopper 78 storing a supply of toner particles in chamber 80 thereof. The lower end portion of chamber 80 has a aperture with the entrance port of dispenser 82 being positioned in communication therewith. Dispenser 82 includes a tubular member having a plurality of apertures therein and an auger. As the auger rotates, it advances the toner particles from hopper 80 along the tube thereof. The toner particles move along the tube and are dispensed through the apertures therein. The detailed structure of toner dispenser 76 will be described hereinafter with reference to FIGS. 3 through 5, inclusive.

By way of example, elongated magnetic member 68 is cylindrical and preferably made from barium ferrite having a plurality of magnetic poles impressed about the circumferential surface thereof. Tubular member 66 is made preferably from aluminum having the exterior surface thereof roughened.

Figure 3:
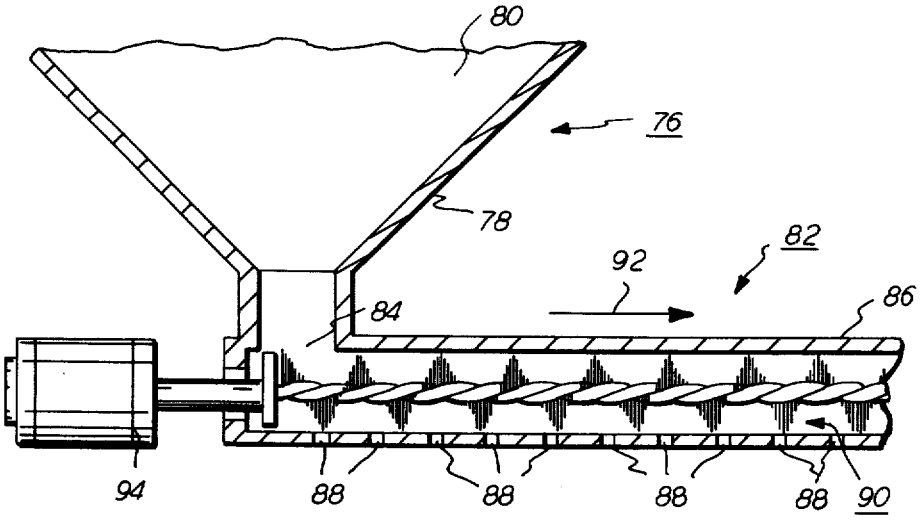
FIG. 3 is a schematic elevational view illustrating the toner particle dispensing system used in the FIG. 2 development system.

Referring now to FIG. 3, toner particles in chamber 80 of hopper 78 descent under the influence of gravity into entrance port 84 of dispenser 82. Dispenser 82 includes a tubular member 86 extending across chamber 72 (FIG. 2) of housing 74 (FIG. 2). In this way, toner particles are substantially uniformly discharged across chamber 72 of housing 74. This facilitates the mixing of the toner particles with the denuded carrier granules.

Tubular member 86 includes a plurality of substantially equally spaced apertures 88 therein. Auger 90 is disposed interiorly of tubular member 86. As auger 90 rotates, toner particles are advanced in the direction of arrow 92. Motor 94 is coupled to auger 90. Actuation of motor 94 causes auger 90 to rotate. Auger 90 includes a multiplicity of substantially flexible fibers extending outwardly from a support shaft. The fibers are wound spirally about the support shaft. The detailed structure of auger 90 will be described hereinafter with reference to FIGS. 4 and 5.

Figure 4:
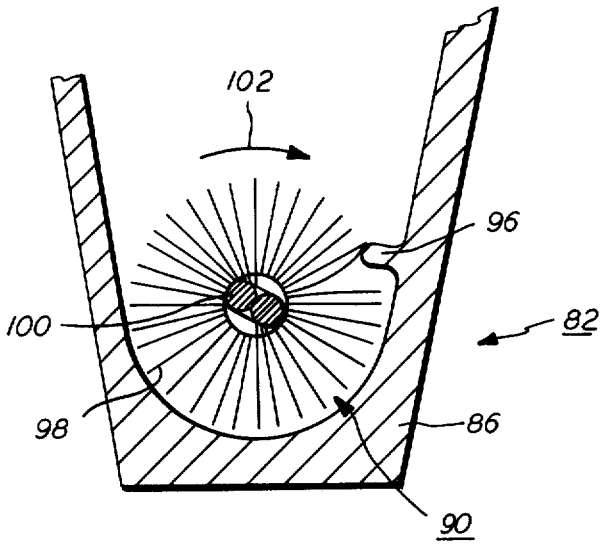
FIG. 4 is a fragmentary, elevational view depicting the transport system used in the FIG. 3 dispensing system.

Turning now to FIG. 4, there is shown a fragmentary elevational view of dispenser 82. As depicted thereat, tubular member 86 has a blade member 96 integral therewith and extending inwardly from the interior peripheral surface thereof. Blade 96 extends the length of tubular member 86. The free end portion of blade 96 engages flexible fibers 98 extending outwardly from support 100. As auger 90 rotates in the direction of arrow 102, fibers 98 are deflected by the free end portion of blade 96. This prevents caking and clogging of the toner particles during the longitudinal movement thereof along tubular member 86. The detailed structure of auger 90 will be described hereinafter with reference to FIG. 5.

Figure 5:
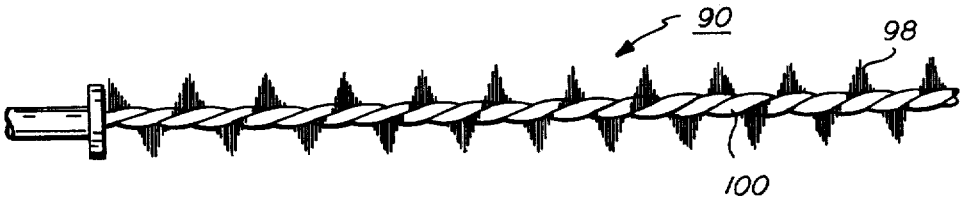
FIG. 5 is an elevational view showing the transport system used in the FIG. 3 dispensing system.

Referring now to FIG. 5, auger 90 includes a support member 100 having a multiplicity of fibers 98 extending outwardly therefrom in a spiral configuration. Preferably, fibers 98 are wound about support member 100 in a helical path. By way of example, fibers 98 are preferably made from a polyamide polymer, such as Nylon. Support member 100 is preferably a pair of wires twisted around one another with fibers 98 being interposed therebetween so as to be secured thereto. By way of example, support member 100 is made preferably from a pair of 15 gauge stainless steel wires twisted about one another so that fibers 98 passing therebetween are wound helically thereabout. The wires are secured to a shank which, in turn, is coupled to motor 94 (FIG. 3). By way of example, the outer diameter of fibers 98 of auger 90 is about 0.50 inches (1.27 centimeters). Flexible fibers 98 are preferably wound in a helix having a pitch of 0.37 inches (0.94 centimeters). A toner dispensing system of this type has a capacity to advance about 9.1 grams per minute of toner particles.

One skilled in the art will appreciate that while tubular member has been shown as being substantially straight, a flexible tubular member may be employed which may be bent to any desired configuration. This is one of the particular advantages of the present invention in that auger 90 readily conforms to the shape of the tubular member since support 100 is flexible.

In recapitulation, it is clear that the toner dispensing apparatus of the present invention includes a hopper storing a supply of toner particles therein and a flexible dispenser for discharging the toner particles substantially uniformly along the chamber of a developer housing. The dispenser includes an auger comprising a flexible support made from twisted wires having a multiplicity of fibers passing therebetween in a helical configuration for advancing toner particles therealong during the rotation thereof. The toner particles are discharged from a plurality of substantially equally spaced apertures or exit ports in the tubular member.

It is, therefore, evident that there has been provided, in accordance with the present invention an apparatus for dispensing toner particles into the developer material of an electrophotographic printing machine. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing an electrostatic latent image recorded on a photoconductive member used in an electrophotographic printing machine, including:

a housing defining a chamber for storing a supply of developer material comprising at least carrier granules and toner particles therein;

means, defining an open ended chamber, for storing a supply of toner particles therein;

a tubular member having an entrance port in communication with the open end of the chamber in said storing means to receive toner particles therefrom and a plurality of substantially equally spaced exit ports for dispensing toner particles therefrom into the chamber of the housing storing the developer material therein;

means for moving the toner particles received in said tubular member from the entrance port to the exit ports therein for dispensing the toner particles therefrom into the chamber of the housing storing the developer material therein, said moving means comprising a support mounted rotatably in said tubular member, and a multiplicity of flexible fibers mounted on said support in a spiral configuration and extending outwardly therefrom with the free end portions thereof being closely adjacent to the interior surface of said tubular member; and means for periodically deflecting and releasing the free end portions of said flexible fibers to prevent caking and clogging of the toner particles moving in said tubular member.

2. An apparatus according to claim 1, wherein said deflecting and releasing means includes an elongated blade integral with and extending inwardly from the interior surface of said enclosure along the length of the elongated chamber with the free end thereof engaging the free end portions of said flexible fibers.

3. An apparatus according to claim 2, wherein said support includes a plurality of wires twisted around one another and having said flexible fibers passing therebetween to be secured thereon.

4. An apparatus according to claim 3, wherein said flexible fibers are wound about said plurality of wires in a helical path.

* * * * *